US011761733B1

(12) United States Patent
Meyrath

(10) Patent No.: US 11,761,733 B1
(45) Date of Patent: Sep. 19, 2023

(54) SINGLE-WIRE COMMUNICATIONS SYSTEM FOR DEVICE OPERATION AND CALIBRATION

(71) Applicant: Todd Philip Meyrath, Henderson, NV (US)

(72) Inventor: Todd Philip Meyrath, Henderson, NV (US)

( * ) Notice: Subject to any disclaimer, the term of this patent is extended or adjusted under 35 U.S.C. 154(b) by 349 days.

(21) Appl. No.: 17/026,160

(22) Filed: Sep. 18, 2020

Related U.S. Application Data

(60) Provisional application No. 62/902,402, filed on Sep. 19, 2019.

(51) Int. Cl.
*F41G 11/00* (2006.01)
*F41G 1/35* (2006.01)
*F41G 3/06* (2006.01)

(52) U.S. Cl.
CPC ..... *F41G 1/35* (2013.01); *F41G 3/065* (2013.01); *F41G 11/001* (2013.01)

(58) Field of Classification Search
USPC ..... 42/85
See application file for complete search history.

(56) References Cited

U.S. PATENT DOCUMENTS 5,862,354 A 1/1999 Curiger
6,412,072 B2 6/2002 Little
8,776,422 B2 * 7/2014 Dodd ..... F41G 11/003 42/72
9,274,578 B2 3/2016 Mullins
9,295,128 B2 3/2016 D'Angelo
10,108,578 B2 10/2018 Ayyagari
10,151,564 B2 12/2018 Galli
10,337,834 B2 * 7/2019 Downing ..... F41G 9/00
10,477,619 B2 * 11/2019 Downing ..... H04W 84/12
10,801,813 B2 * 10/2020 Moseman ..... F41G 1/38
11,067,367 B2 * 7/2021 Delgado Acarreta ... H04L 67/61
2012/0131840 A1 5/2012 Toole
2020/0064102 A1 2/2020 Galli

FOREIGN PATENT DOCUMENTS

EP 3304672 B1 * 11/2018 ..... G06F 1/26

* cited by examiner

*Primary Examiner* — Reginald S Tillman, Jr.
(74) *Attorney, Agent, or Firm* — Daniel Klemer

(57) ABSTRACT

A single-wire serial data communications bus is established between an electronic accessory, such as an optical laser sight, and a host controller, using an externally accessible connector on the electronic accessory generally having another primary purpose, such as connection of a remote switch. The need for more complex connection schemes for calibration and control of the electronic accessory is thus eliminated. Furthermore, the single-wire bus enables a range of other host devices, such as a smart switch or an ambient light sensor module, which may provide more complex control options by sending serial control commands to the unit. Additionally, connected hosts may be parasitically powered through the communications bus to eliminate the need for separate batteries.

16 Claims, 7 Drawing Sheets

SINGLE-WIRE COMMUNICATIONS SYSTEM FOR DEVICE OPERATION AND CALIBRATION

CROSS-REFERENCE TO RELATED APPLICATIONS

This application claims the benefit of priority from U.S. provisional patent application No. 62/902,402, filed Sep. 19, 2019, entitled "Single-Wire Communications System for Device Operation and Calibration," which is herein incorporated by reference in its entirety.

FIELD

The present invention relates to optical sighting devices, optical aiming devices, and other electronic accessories designed for use with firearms.

BACKGROUND

Many electronic accessories have been developed for use with firearms to assist in aiming a weapon and improving the accuracy of landing a projectile on the intended target. Among these are optical sights, including laser pointers, telescopes with projected virtual dots or patterns, and video sights with superposed information and target alignment features. Laser pointer sights operate by projecting a substantially collimated laser beam along a path aligned to the trajectory of projectiles launched from the firearm such that the laser beam intersects the target at the point at which a projectile is expected to impact. Telescope sights with projected features operate by optically projecting a precisely-aligned dot or pattern to the virtual location of the target, such that the dot or some feature of the pattern coincides with the expected impact point of a projectile launched from the firearm. Video sights combine an electronically-generated video pattern with images acquired from a camera, aligned such that some feature of the pattern is superposed on the image in the precise location at which the launched projectile is expected to strike the target.

Each of these electronic sights may use an integrated pushbutton switch to active or deactivate the sight, and frequently, external switches are employed to enable greater flexibility in configuring and operating the firearm. Such external switches are often attached to the electronic sight through a connector so that they can be attached and detached from the sight quickly and easily, and most commonly, these switches are connected through only two wires, including an activation wire and ground.

Optical sights typically employ a microcontroller or microprocessor to control the primary functions of the optical sight during normal operation, including interrogating the state of switches, interrogating one or more sensors, activating or deactivating one or more optical sources, setting or controlling the optical output power of these optical sources, or modulating one or more of the light sources. Sensors may include temperature sensors, optical ranging modules, or ambient light sensors, among others; optical sources may include lasers, LEDs, or incandescent illuminators, among others.

During their manufacture, these optical sights are often required to undergo a procedure to test and verify their proper operation and to calibrate certain operating parameters, as well, such as laser optical output power. Additionally, an optical sight may be configured to operate according to various options, such as different responses to button presses when they are single-clicked, double-clicked or pressed and held, for example. A switch may be used to select different optical source power settings, among other functions.

The microcontroller that controls primary operation of the optical sight may also be used to implement these test, calibration and configuration functions, which typically require certain information, such as requested optical source drive level, for example, to be exchanged between a manufacturing host computer and the optical sight being tested, calibrated or configured. This information is typically communicated through a digital interface which connects a communications port on the manufacturing host computer to one or more communications ports on the optical sight. Typically, standard communications interfaces are employed, which may include a parallel bus, Universal Asynchronous/Synchronous Receiver/Transmitter (UART/USART), Universal Serial Bus (USB), Serial Protocol Interface (SPI), Inter-Integrated Circuit (I2C), RS232, RS485, or other standard types. Each of these interfaces requires at least 3 wires, including ground. Therefore, prior art systems typically require special connectors dedicated to communications with the microcontroller or microprocessor on the optical sight. Since these connectors are generally used only during manufacturing or in other rare situations, such as diagnostic troubleshooting, they are typically not designed to be accessible when the optical sight is completely assembled. This in turn requires that the unit be fully or partially disassembled when being tested, calibrated or configured. In addition to extra labor cost, disassembling the unit and working with the unit in a disassembled state often introduces stresses on internal connections, which can lead to product failure, reduced product reliability, and inaccuracy of testing and calibration. Moreover, addition of one or more special connectors increases the product size and cost. Designing the product such that the connector is accessible when the unit is fully assembled results in an increase in design complexity and further additions to size and cost, particularly in cases in which the product must be sealed against water or moisture intrusion into the housing. Often these connectors are difficult to access if they are situated inside the product housing, leading to more complicated manufacturing procedures and additional cost of production. For example, pogo connectors with multiple pins are commonly used to connect a calibration or test host computer to a unit-under-test (UUT). These pogo connectors are often susceptible to shorting or improper engagement of the pins, leading to inefficient manufacturing processes or even damage to the product hardware or to the host computer. It would therefore be much preferred to be able to perform these functions on the optical sight when it is in a fully assembled state.

While it is indeed possible to have externally accessible ports with multiple connections, such ports are more expensive to implement, they are susceptible to damage to internal components caused by accidental shorting of one or more of the lines, and they are less reliable due to exposure to water and other elements of the environment. Moreover, many products already exist with a reliable proven single-line (plus ground) interface intended to support remote operation using an externally-connected switch. It is therefore also preferred that any externally-connected means for calibration or remote operation of the accessory utilize an existing single-line port on the device, rather than require an additional more complex interface to be designed in.

SUMMARY

The present invention seeks to overcome the limitations and disadvantages of the prior art by providing a system hardware design and a method of communications such that external devices and systems are able to communicate digitally with the optical sighting device or other electronic accessory via a single-wire connection through an existing connector principally designed for another primary product function, such as an external switch. In this way, an existing connector on the accessory can be temporarily repurposed for configuration or calibration functions during product manufacture. Since the connector is accessible when the product is completely assembled, the present invention addresses the limitations and disadvantages of the prior art by obviating the need for access to special secondary connectors used only at manufacturing time.

An additional benefit of the present invention is the ability to retrofit existing systems to implement communications with an external system, device or accessory, with only minimal modification of the electronics and firmware design; since existing connectors are used for interface, generally no modification of the mechanical design is required. Since electronics and firmware design modifications are generally less expensive than mechanical design modifications, the present invention minimizes the cost required to retrofit existing systems. In some cases, no modification to the hardware may be necessary, as switch inputs may already be connected to a port on a central microcontroller that controls the operation of the accessory, and communication through the existing port connection may be implemented via firmware emulation of a serial communications protocol, or input to the port may be internally directed to a serial communications peripheral of the microcontroller for the purpose of communicating with an external host. Each of these options requires only modification of the microcontroller firmware.

In addition to providing test, calibration and configuration functions during manufacture, the single-wire interface also enables the use of complex peripheral accessories, such as smart switches, external sensors, external indicators, or unit to unit communication.

A smart switch, in contrast to a simple on-off switch, is an external control accessory that can cause the optical sight to function in one or more alternate modes of operation by communicating operational commands to the optical sight through the digital communications interface. Having access to the full set of operational commands for the unit allows a smart switch to provide more complex and configurable functionality than would ordinarily be available as part of the standard operation of the product. For example, an external switch control may have multiple switches for activating separate light sources individually or in combination, such as a visible laser pointer, an infrared laser pointer, a visible illuminator, and an infrared illuminator. To implement such an interface without serial communications would require separate input ports for each external switch.

External sensors could be used to provide environmental or operational measurement feedback to the unit through the communications interface to modify the behavior of the unit; for example, ambient light levels could be measured and fed back to the optical sight so that the optical source power could be changed to compensate for brighter or dimmer illumination conditions.

In another aspect of the present invention, the single-wire bus can additionally supply power to external control accessories, such as smart switches or sensors, which require power to operate internal electronic components, including microcontrollers, sensor amplifiers, analog-to-digital converters, and more. In this case, when no connected node is transmitting, the bus is pulled high through a pull-up resistor, and an external control accessory may employ a circuit to store energy from the single-wire bus and supply power to the internal electronic components, even when information is being transmitted. An example of an energy storage circuit is a capacitor connected through a diode to the single-wire bus. The diode is connected so as to ensure that current always flows into the capacitor from the single-wire bus and never drains from the capacitor out to the bus, even when the bus is pulled low. Alternatively, a semiconductor switch could be used to connect the single-wire bus to a capacitor whenever the bus is at a higher voltage than the capacitor. Provided that the power required to operate the internal electronic components is less than the average power that can be supplied through the single-wire bus, a control accessory can be powered continuously through the bus. This process is generally known as "parasitic powering" of the control accessory. A monitor circuit or microcontroller within the control accessory may additionally monitor the energy stored in the capacitor and regulate communications on the bus according to the capacitor charge state to ensure that the stored energy does not fall below the minimum level required to maintain operation of the control accessory. Additionally, a voltage regulator, such as a switch-mode boost regulator may be employed to ensure that the power supply voltage is maintained at a constant level, even when the voltage across the capacitor fluctuates due to modulation of the single-wire bus for information transmission, or due to changes in power consumption by the control accessory. The communications protocol may be altered as well, for example by including delays between transmitted blocks of data, to ensure that a minimum amount of power is always available through the single-wire bus.

DETAILED DESCRIPTION

Figure 1:
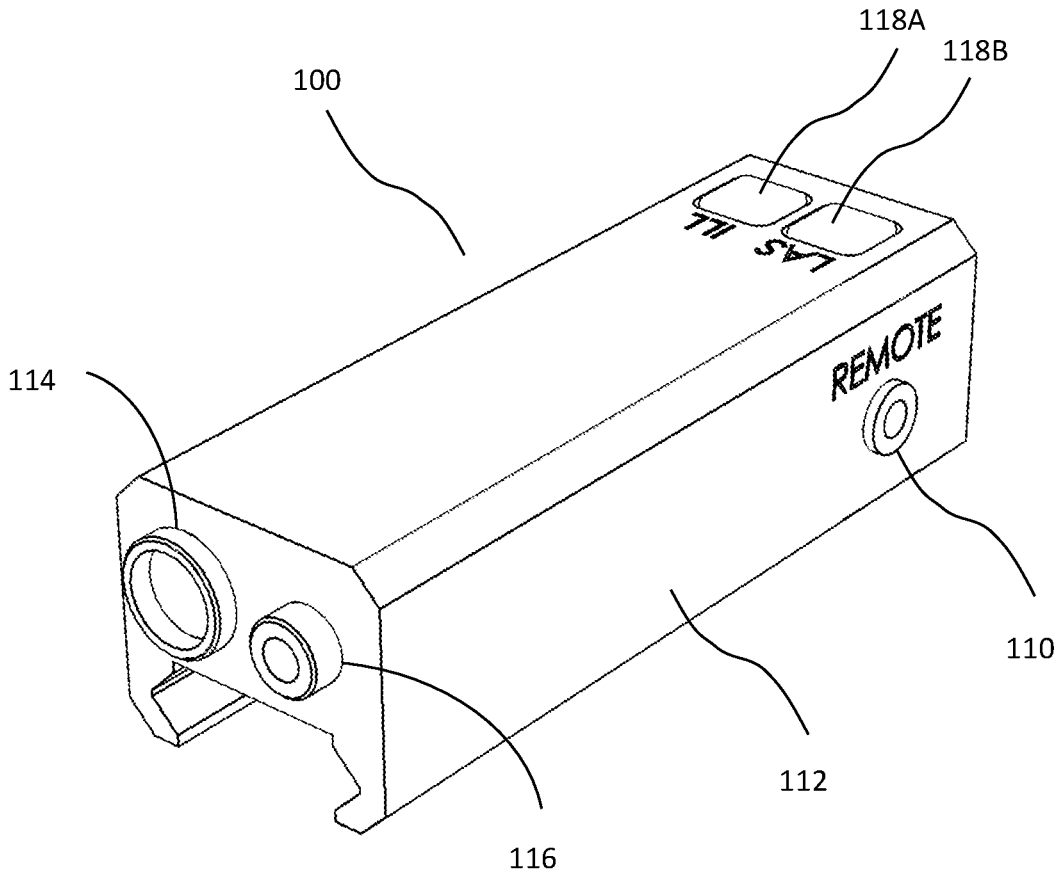
FIG. 1 is a perspective view of a weapon accessory.

Within the context of the present invention, the following definitions apply:

- "accessory" and "electronic accessory" may refer to a device comprising electronics designed to perform a specific function;
- "sight", "aiming device", and "electronic weapon accessory" may be used synonymously to refer to an accessory for use with a weapon to assist in aiming the weapon at a target, illuminating a target or a target scene, or otherwise enhancing the operation, performance or usability of the weapon;

"computer" may refer to a laptop or desktop computer, single-board computer, computing module, tablet, smartphone, embedded controller, microcontroller, microprocessor, or other computing means capable of performing a sequence of tasks according to a programmed set of instructions;

"program" and "firmware" may refer to a stored sequence of instructions that a computer may perform to carry out a set of tasks;

"program update" for a program contained in a memory may refer to a collection of instructions and data that a computer may use to selectively modify the program in a predetermined way;

"host", "host system", "host device", "host computer" and "host controller" may be used synonymously to refer to a device or system, such as a computer or other electronic circuit, which may be removably and selectively connected to an accessory for the purpose of controlling, calibrating, configuring or testing the accessory, or updating its embedded firmware code;

"connector" and "connection port" may be used synonymously to refer to an electro-mechanical device to which a mating connector may be removably and selectively connected so as to form an electrical connection;

"bus" and "communications bus" may refer to a connection between communication nodes for the purpose of relaying information between the nodes;

"node" may refer to a device having capability of transmitting, receiving, or transmitting and receiving information through a communications bus;

"open-drain bus" and "open-drain communications bus" may refer to a communications bus on which the transmission channel for each node is connected to the bus through an open-drain buffer or through a field-effect transistor in an open-drain configuration;

"open-collector bus" and "open-collector communications bus" may refer to a communications bus on which the transmission channel for each node is connected to the bus through an open-collector buffer or through a bipolar junction transistor in an open-collector configuration;

"open-drain buffer" may refer to a device in which the output is controlled by a transistor in an open-drain configuration, and designed so that a high input to the buffer turns off the transistor, and a low input turns on the transistor;

"open-collector buffer" may refer to a device in which the output is controlled by a transistor in an open-collector configuration, and designed so that a high input to the buffer turns off the transistor, and a low input turns on the transistor;

"single-wire bus" and "single-wire communications bus" may be used to refer to a bus configuration having a single communications channel through which serial data is transmitted and received;

"performance parameter" of an electronic accessory may refer to a measurable quantity, such as optical power output, describing the degree to which the electronic accessory performs an intended function;

"control command" may refer to a set of information, such a sequence of digital data bytes that is communicated to an accessory to cause the accessory to perform a particular action as described by the specific information contained in the set;

"control element" may refer to a device, such as a switch, a sensor, or a transducer, for which a parameter of the control element may be used to determine appropriate control directives for an accessory.

In an open-drain bus, the communications bus is pulled high through a pull-up resistor to a common power supply voltage for the system. Each transmitter connects to the bus through an open-drain buffer. When the bus is in an idle state, for which none of the nodes is transmitting, each transmitter drives the input to its buffer high, thereby turning off the buffer output transistor and releasing the bus, which consequently remains in a high state. When one of the transmitters is transmitting, it can drive the input to its buffer low, which in turn connects the bus to ground through the relatively low impedance of the output transistor. The pull-up resistor is chosen to have a resistance very much higher than the impedance of the transistors in their on state, so that each transmitter may modulate the state of the bus between substantially the voltage of the power supply and substantially ground.

An open-collector bus works in much the same way as the open-drain bus, except that each transmitter connects to the bus through an open-collector buffer. When the bus is in an idle state, for which none of the nodes is transmitting, each transmitter drives the input to its buffer high, thereby turning off the buffer output transistor and releasing the bus, which consequently remains in a high state. When one of the transmitters is transmitting, it can drive the input to its buffer low, which causes substantial current to flow through the transistor, consequently forcing the bus low. The pull-up resistor is chosen to have a resistance such that the saturation current through the transistor is sufficient to drop substantially the full power supply voltage across the pull-up resistor, so that each transmitter may modulate the state of the bus between substantially the voltage of the power supply and substantially ground.

Operating in an open-drain or open-collector configuration prevents the situation in which two nodes are simultaneously trying to drive the communications bus to differing levels, which could result in large currents flowing between the two nodes. This configuration also allows for variable high voltage levels.

In another aspect of the present invention, more than two devices may be connected together to independently transmit and receive information through the single-wire bus, since each node may transmit data on the bus by pulling the bus low through its open-drain or open-collector buffer. While any information on the bus will be obfuscated if more than one device attempts to transmit data at the same time, no negative effect on or damage to the electronics hardware will result. As long as the communications scheme ensures that only one node transmits data on the single-wire bus at any one time, information can be reliably and efficiently exchanged among multiple connected devices. For example, a message may include additional device address information that specifies which device the message is intended for. Only the device configured with that address then processes the message and sends a response. Or in a bulk-update operation, a central host may unidirectionally transmit updated configuration information to a batch of connected accessories using commands that demand no response from the accessories, thereby increasing the rate at which products may be processed.

The term "single-wire" refers to a single active communications channel; actual physical implementation requires a common ground reference between an accessory and a connected host or control accessory, so that a second wire is typically used to connect the respective grounds. Alternatively, if the accessory is enclosed in a metal housing, the housing may be connected to the control circuit ground inside the unit, and an external host system may establish a connection between its ground and the housing, perhaps through a metal rail or other mounting feature used to attach the accessory to a weapon.

"Connecting with", "communicating with", "establishing a communications bus with", "transmitting to" or "receiving from" a host system or an electronic accessory are understood to mean connecting with, communicating with, establishing a communications bus with, transmitting to or receiving from the electronic circuit or device within the host system or electronic accessory configured to process serial communications data.

Referring to the drawings, an example of an electronic weapon accessory is shown at 100 in FIG. 1, having a housing, 112, an illuminator 114, and a laser source 116, buttons 118A and 118B for controlling operation of the unit, and connector 110 to which a remote switch, host system, or other compatible device may be removably and selectively connected.

Figure 2:
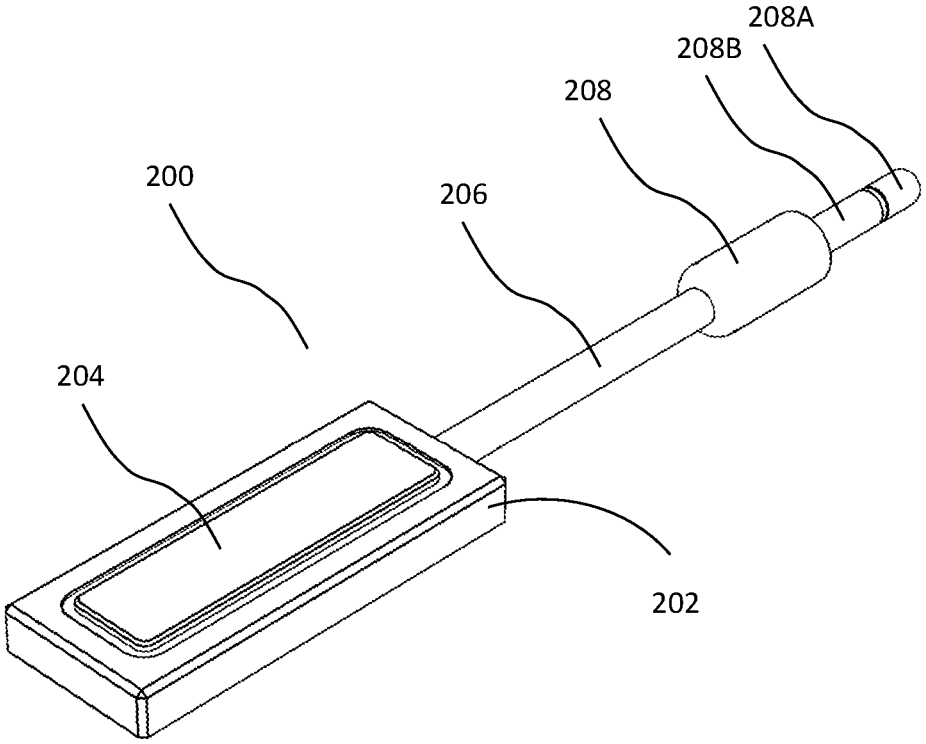
FIG. 2 (PRIOR ART)
FIG. 2 is a perspective view of a typical prior-art remote switch used to activate the laser accessory.

FIG. 2 shows an example of a prior-art remote switch module 200, having a housing 202, a pushbutton switch 204, a two-wire cable 206, and plug 208, the plug having ground electrode 208B connected through one of the wires in the cable to one side of switch 204, and signal electrode 208A connected through the other wire in the cable to the remaining side of switch 204.

Figure 3:
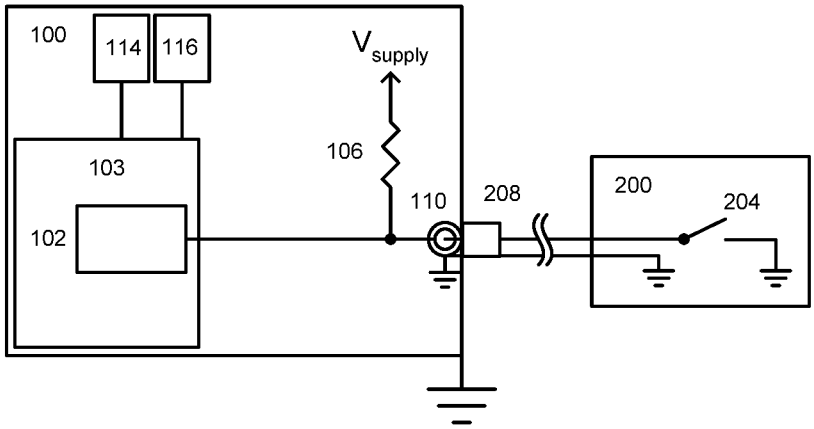
FIG. 3 (PRIOR ART)
FIG. 3 is a schematic view of a typical prior-art system, illustrating the electrical operation of the remote switch.

FIG. 3 shows a schematic diagram of relevant portions of the electrical connections within accessory 100 and within remote switch 200 for typical prior-art operation using a remote switch. Embedded computer 103 controls the operation of the accessory, and input-output (10) port 102 of embedded computer 103 is connected to connector 110, and through the pull-up resistor 106 to the supply voltage for the accessory, $V_{supply}$.

When remote switch 200 is connected to accessory 100 by inserting plug 208 into connector 110, one side of switch 204 is connected through cable 206, plug 208 and connector 110 to 10 port 102, and the other side is connected to accessory ground. As long as the switch remains open, the voltage at 10 port 102 is maintained at substantially the level of $V_{supply}$ through pull-up resistor 106, and embedded computer 103 will detect a high signal at port 102. Resistor 106 is selected to have a resistance very much larger than the resistance of switch 204 in its closed state, so that when the switch is closed, it pulls the voltage at 10 port 102 substantially to ground, and embedded computer 103 will detect a low signal at port 102. By detecting when the signal at port 102 changes, therefore, embedded computer 103 can respond to remote switch events and control the operation of the accessory according to its programmed behavior.

Figure 4:
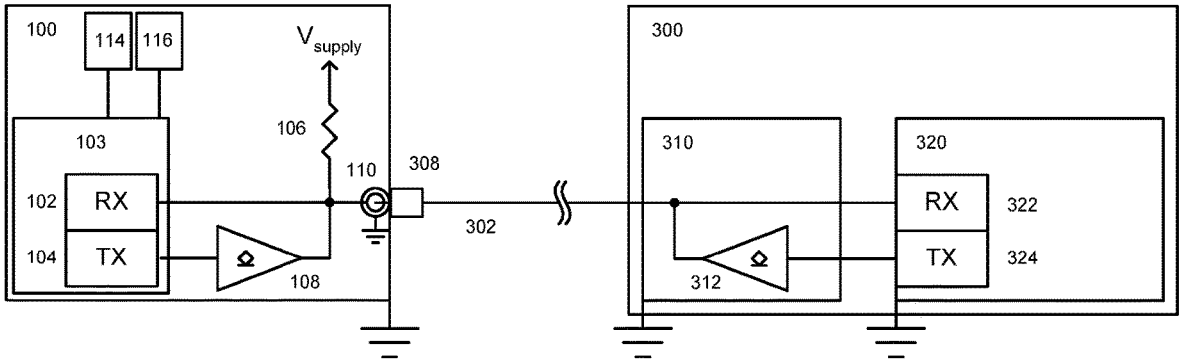
FIG. 4 is a schematic view of a single-wire communications system, with a transmitter, designated by TX, and a receiver, designated by RX for each node on the communications bus.

FIG. 4 shows a schematic diagram of relevant portions of the electrical connections within accessory 100 and within host system 300, which interfaces to single-wire bus 302 through plug 308 and connector 110 for the preferred embodiment of the present invention. Receiver port 102, labeled "RX", is an input port on embedded computer 103, which controls operation of the accessory, and receiver port 102 connects directly to single-wire bus 302. Transmission port 104, labeled "TX", is an output port on embedded computer 103, and is connected to the input of open-drain buffer 108. The output of the open drain buffer 108 is connected to single-wire bus 302.

Likewise, host receiver port 322, also labeled "RX", is an input port on host computer 320, which controls operation of the host. Host transmission port 324, also labeled "TX", is an output port on host computer 320. Host receiver port 322 is connected directly to single-wire bus 302 through host adapter 310. Host transmission port 324 connects to the input of open-drain buffer 312. The output of open-drain buffer 312 is connected to single-wire bus 302.

Pull-up resistor 106 holds the voltage at receiver port 102 at substantially the level of $V_{supply}$, provided that 1) the output of transmission port 104 is high, thereby deactivating the output of open drain buffer 104, 2) the output of host transmission port 324 is high, thereby deactivating the output of open drain buffer 312, and 3) there are no other elements connected to and drawing substantial current from the single-wire bus 302.

In the preferred embodiment, the host system first transmits a control command to the accessory by digitally modulating the state of single-wire bus 302 according to a UART protocol for serial digital data transmission. While any of various serial protocols could be used for communications, the UART protocol is well-suited for an open-drain single-wire communications system, since 1) UART is asynchronous, and no separate clock signal is required, 2) the idle state for the bus is high, so when both transmitters are idle, they naturally release the bus by deactivating their open drain buffers, 3) UART supports relatively high data transfer speed up to several megabits per second (Mbps), and 4) most embedded microcontrollers and computers have built-in hardware that implements the UART protocol, and even in the case that the protocol is not implemented in hardware, there are many libraries and code examples that are freely available to implement the UART protocol in firmware. Moreover, only a minimal number of external components are necessary to enable a standard UART to operate in the single-wire configuration of the present invention.

An example of a control command is the string "LPOW 5.2" followed by a carriage-return character code 13, which may indicate that the accessory should set the optical power level of the laser source to 5.2 milliwatts. The host sends the control command to the accessory, which then performs the requested action and acknowledges the command by returning "LPOW ERR 0" followed by a carriage return, thereby indicating that the command was successfully executed.

In another aspect of the preferred embodiment, a command protocol is implemented consisting of the host transmitting a first value indicating the length of a message, a second value indicating a command, or action to be performed, zero or more values containing parameters related to the requested action, and optionally one or more values for error detection or correction. If less than the expected length of message is received by the accessory within a predetermined timeout period, the accessory may disregard the partial message and reset the communications state. If a complete message is received before a timeout occurs, the accessory then responds with a message containing a first value indicating the length of the response, one or more values containing information returned by the requested action, one value repeating the requested action, and one or more values indicating an error code, if an error occurred, or a code indicating that no error has occurred. If no response is received, or less than the expected length of response is received from the accessory within a predetermined timeout period, the host system can assume that the communication was unsuccessful, and additional actions can be taken to recover, or the communications state may be reset. Using such a protocol, single-wire communications can be effectively and efficiently conducted, since each node is synchronized through handshaking to avoid both nodes trying to drive the communications bus simultaneously, which would otherwise lead to bus collision and loss of transmission.

Such a protocol additionally accommodates messages of any length, which allows for implementation of flexible functionality. Because of this flexibility, the method can be used not only for calibration and configuration functions, but also for firmware code updates or other complex communications between the device and an external host. This is particularly advantageous, for example, for enabling technicians in sales distribution or repair centers, or even end users to update product firmware to fix firmware bugs or to add operational features and improvements without the need for hardware disassembly. The format of the dynamic communications protocol described may vary in position and length of information values, and additional values may be included, or certain values may be removed to fit the precise needs of the application, as well.

Moreover, computer 103 in accessory 100 can be programmed to detect activity on single-wire port 302 and determine whether the activity is associated with the operation of a switch, for example, or with digital communications from a host system. There are many ways to accomplish this detection, but in the preferred embodiment, a hand-shaking protocol is used, in which host 300 sends a known data sequence to the accessory until the accessory responds with an expected acknowledgement sequence. At this point, communications between the two nodes is established, and further exchange of information can proceed. Additionally, each communications data sequence can include error detection or error correction bytes, so that only valid data sequences will be processed by computer 103. If valid serial data is not detected, computer 103 may then respond to changes in signal state on the same port in a way consistent with its operation as a switch input. For example, when engagement of an external switch attached to input port 110 pulls the input low, computer 103 may determine that the logic low signal is generated by a switch provided that it persists for a predetermined minimum time, for example 10 milliseconds, corresponding to a deliberate switch press, and respond by turning on the laser pointer source. At the same time, switch bounce or other noise associated with the switch press may cause computer 103 to interpret the initial switch event as one or several bytes of serial data. However, the data will quickly be determined to be invalid, and therefore, ignored. When the input returns high for a predetermined minimum time, computer 103 may then turn off the laser pointer source.

Alternatively, if a port 102 is designed to interface to an analog signal, the voltage of the input signal could be measured by computer 103, and signals within a certain voltage range would be interpreted as analog signals, for example, and outside this range, the signals would be interpreted as communication signals.

It is clear that because the transmitter and receiver of each node are effectively both connected to the same bus in the configuration of FIG. 4, all information transmitted by a node will be simultaneously received by the same node, and the information thus received is herein referred to as "echo".

Since a node may anticipate echo when transmitting data in such a configuration, received echo data may simply be ignored by the transmitting node, perhaps with verification that it matches the transmitted data to prevent any data loss. However, situations exist for which it would be advantageous to block, or cancel, this echoed data from being received altogether. For example, a host system may be modified from a traditional dual-wire configuration to a single-wire configuration, and modification of the host software or firmware to accommodate echo would be impractical. Moreover, a host may need to be capable of communicating with both single-wire and dual-wire products. Eliminating the echo in hardware then greatly simplifies the design of the PC software, since the system will respond in the same way for both single- and dual-wire systems in this case.

Figure 5:
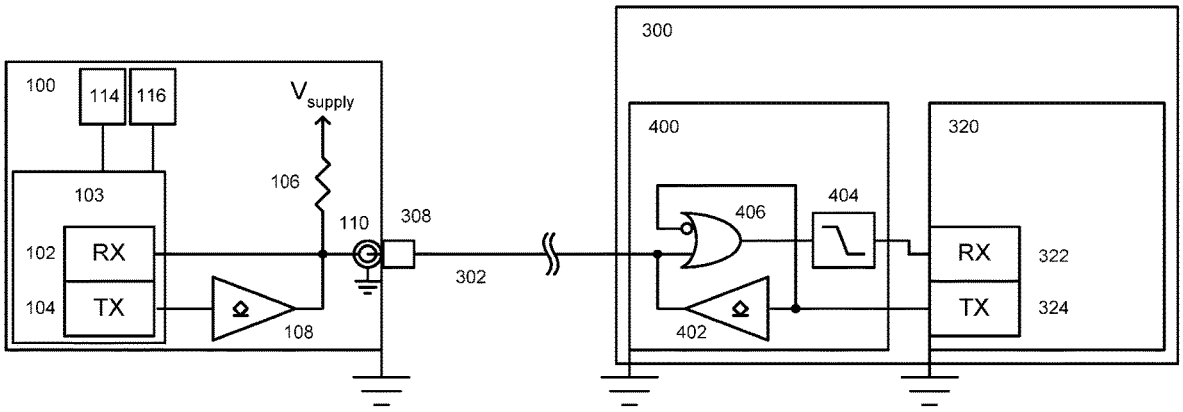
FIG. 5 is a schematic view of a single-wire communications system including echo cancellation on the host computer node.

FIG. 5 shows a schematic view of another preferred embodiment, in which the need for "echo cancellation" is addressed by a modified host adapter 400. In this configuration, data from single-wire bus 302 is connected to the first input of OR gate 406. The output of OR gate 406 then passes through low-pass filter 404 before entering receiver port 322 of computer 320 in the host system 300. The inverted second input to gate 406 receives the same transmitted signal from transmission port 324. When neither the host nor the accessory are transmitting, single-wire bus 302 will be high, and the output of gate 406 will be high, and the state is equivalent to that of FIG. 4. When the host is not transmitting and the accessory is transmitting, the signal on the inverted second input to gate 406 will be high, and thus the output of gate 406 will follow the state of the single-wire bus. When the host is transmitting and the accessory is not, both inputs to gate 406 will be the same, and the output will always be high, thus the modulated signal on the bus will effectively be blocked from reaching receiver port 322.

Alternatively, gate 406 may be replaced with an open-drain data buffer having an enable line in place of its inverted input, with its input connected to the single-wire bus, and the output connected through a pull-up resistor to the power supply.

Low-pass filter 404 filters out glitches or fast transients that may occur as a result of short signal propagation delays through the gate and other electronic components in the circuit, or from other hardware timing issues. The filter may be designed so that it substantially reduces the magnitude of these glitches, while having minimal effect on the serial data signal. It should be noted that filter 404 may not be necessary, and therefore may be removed in some design embodiments.

While echo cancellation is shown only in the host system in FIG. 5, echo cancellation could also be implemented in the accessory, as well, utilizing the same adapter circuit 400.

In one preferred embodiment, host system 300 performs a calibration of accessory 100. It begins by transmitting a control command to cause the accessory to turn on laser pointer 116 with a nominal starting value for the drive current calibration parameter sufficiently low to avoid overdriving the laser. The host system communicates with and acquires measurements of optical power from an optical power meter having a sensor disposed to intercept the laser pointer beam. From these measurements, the host system calculates a new calibration parameter value for laser drive current to achieve a target laser power, and transmits the new calibration parameter to the accessory. The host system then reacquires power measurements from the optical power meter and determines whether the optical power is within the allowed tolerance. If the optical power remains outside the allowed tolerance limits, the host system repeats the calibration parameter calculation using the new power measurements, and again transmits the calibration parameter value to the accessory. If a suitable calibration parameter is not found within a limited number of iterations, the host system may abandon the calibration procedure for the unit-under-test (UUT) and indicate to the user that the calibration failed. However, if calibration of the laser pointer succeeds, the host system may perform a similar procedure to calibrate the output power from illuminator 114. Once a suitable calibration parameter value is found for the illuminator, the host system transmits a control command to cause the accessory to save all calibration parameters, and the host system indicates to the user that the calibration succeeded.

Figure 6:
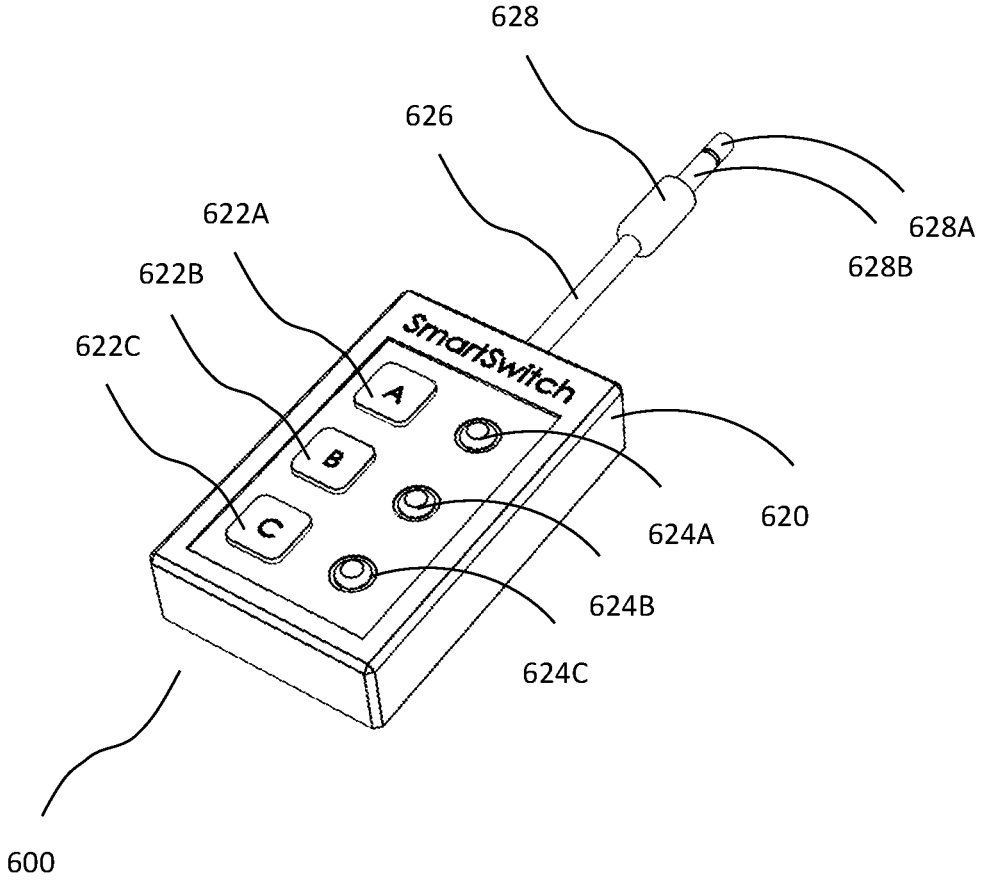
FIG. 6 is a perspective view of a smart switch incorporating advanced capability for controlling the laser accessory.

Turning to FIG. 6, another embodiment is seen in smart switch 600, having a housing 620, buttons 622A, 622B, and 622C, indicators 642A, 642B, 642C, a two-wire cable 626, and plug 628, the plug having ground electrode 628B connected through one of the wires in the cable to the ground side of the smart switch circuit, and signal electrode 628A connected through the other wire in the cable to the control signal of the smart switch circuit.

Figure 7:
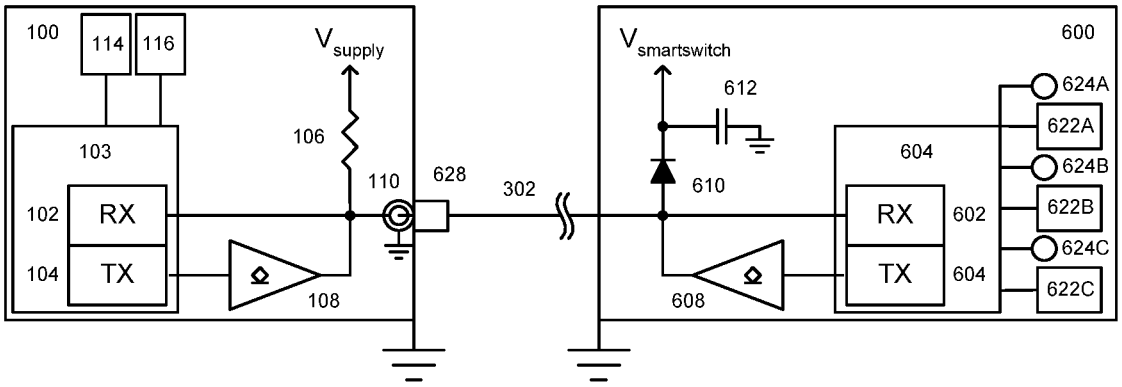
FIG. 7 is a schematic view of a single-wire communications system as connected to a smart switch controller.

FIG. 7 shows a schematic view of relevant portions of the electronics for accessory 100 and smart switch 600. As in FIG. 4 for the host system, FIG. 7 connects embedded computer 604 to the single-wire communications bus in an open-drain configuration. Buttons 622A, 622B, 622C on the smart switch and indicators 642A, 642B and 642C are connected to computer 604, which formulates and transmits control commands to the accessory according to its programmed behavior when one of the buttons is pressed. Computer 604 may additionally issue control commands to request information from the accessory, such as battery charge level, and set the state of the indicators correspondingly. For example, a red LED indicator may flash when the battery charge in the electronic accessory drops below 20%.

The schematic of FIG. 7 also illustrates a means of parasitically powering the smart switch. "Parasitically powering" a device is a process in which power is derived for operation of the device through a channel having a primary intended function other than power delivery. In this embodiment, the primary function of the single-wire bus is communication of information; however, it is possible to parasitically power the smart switch by diverting energy from the single-wire bus through diode 610, and storing the energy in capacitor 612. When the bus is idle, its voltage is substantially at $V_{supply}$. When data is transmitted through the bus, the bus voltage will remain at substantially zero for a fraction of the time which depends on the specific data values. During periods in which the bus is held low, energy stored in capacitor 612 can continue to power the smart switch circuit, and diode 610 prevents energy from flowing back into the bus. The amount of current available to power the smart switch is limited by pull-up resistor 106, so pull-up resistance must be chosen sufficiently low to enable continuous powering of the circuit, yet sufficiently high to enable deep modulation of the serial data signal.

Moreover, computer 604 may monitor the state of charge on capacitor 612 and adjust the length and timing of communications to prevent the charge from dropping below the threshold for maintaining circuit operation.

While the smart switch in FIG. 6 and FIG. 7 incorporates three switches as control elements, there are many other types of control elements that may be incorporated in the smart switch, or indeed incorporated in other independent control accessories to adjust the operation of the electronic accessory in response to various types of input. Examples of control elements include a potentiometer, a light sensor, a range sensor, a temperature sensor, a humidity sensor, a biometric sensor, a voltage sensor, a current sensor, and a sound sensor. For example, an ambient light detector may be used to measure the ambient light level and adjust the power output of the laser pointer to optimize visibility of the laser pointer beam on a target.

It should be noted that though the present invention is described herein in the context of electronic sights designed for use with firearms, the same single-wire communications system could be employed effectively on systems in many other application areas without deviating from the scope of the present invention.

What is claimed is:

1. A system for communicating information between a host controller and an electronic weapon accessory comprising:

a. an electronic weapon accessory comprising:

i. an electronic control circuit;

ii. an electrical connection port electrically connected with the electronic control circuit;

b. a host controller;

wherein the host controller is configured to be removably and selectively electrically connected with the electrical connection port to establish a bidirectional single-wire communications bus between the host controller and the electronic weapon accessory;

wherein the host controller is configured to transmit serial data through the bidirectional communications bus and the electronic weapon accessory is configured to receive serial data through the bidirectional communications bus.

2. The system of claim 1, wherein the host controller is further configured to receive serial data through the bidirectional communications bus and the electronic weapon accessory is further configured to transmit serial data through the bidirectional communications bus.

3. The system of claim 1, wherein the electronic weapon accessory further comprises a housing; wherein the electrical connection port is disposed on a surface of the housing.

4. The system of claim 1, wherein the host controller further comprises:

a. measurement means for measuring at least one performance parameter of the electronic weapon accessory;

b. a computer;

wherein the computer is configured to acquire at least one measurement from the measurement means, calculate from the at least one measurement at least one calibration parameter of the electronic weapon accessory, and transmit the at least one calibration parameter to the electronic weapon accessory.

5. The system of claim 1, wherein the host controller further comprises:

a. at least one control element;

b. a computer;

wherein the computer is configured to measure at least one parameter of the at least one control element and transmit control commands to the electronic weapon accessory to control the operation of the electronic weapon accessory in response to changes in the at least one parameter of the at least one control element.

6. The system of claim 5, wherein the at least one control element is one of a switch, a potentiometer, a light sensor, a range sensor, a temperature sensor, a humidity sensor, a biometric sensor, a voltage sensor, a current sensor, and a sound sensor.

7. The system of claim 1, wherein the electronic weapon accessory further comprises:

a. a computer;

b. a memory, containing at least one program executed by the computer;

wherein the computer is configured to selectively modify the at least one program and the host controller is configured to transmit to the electronic weapon accessory a program update for the at least one program.

8. The system of claim 1, wherein the communications bus further comprises one of an open-drain and an open-collector communications bus.

9. The system of claim 1, wherein the host controller further comprises echo cancellation means to preclude the host controller from receiving serial data that is transmitted by the host controller.

10. The system of claim 1, wherein the electronic weapon accessory further comprises echo cancellation means to preclude the electronic weapon accessory from receiving serial data that is transmitted by the electronic weapon accessory.

11. A method for communicating information between a host controller and an electronic weapon accessory having an electronic control circuit and an electrical connection port connected to the electronic control circuit, comprising:

a. connecting the host controller to the connection port of the electronic weapon accessory to establish a bidirectional single-wire communications bus between the host controller and the electronic weapon accessory;

b. transmitting first serial data on the communications bus from the host controller;

c. receiving the first serial data on the communications bus by the electronic weapon accessory.

12. The method of claim 11, further comprising:

a. transmitting second serial data on the communications bus from the electronic weapon accessory;

b. receiving the second serial data on the communications bus by the host controller.

13. The method of claim 11, wherein the serial data comprises at least one calibration parameter of the electronic weapon accessory.

14. The method of claim 11, wherein the serial data comprises at least one control command to control the operation of the electronic weapon accessory.

15. The method of claim 11, further comprising precluding the host controller from receiving serial data transmitted by the host controller.

16. The method of claim 11, further comprising precluding the electronic weapon accessory from receiving serial data transmitted by the electronic weapon accessory.

* * * * *